US006431945B1

(12) United States Patent
Stephens et al.

(10) Patent No.: US 6,431,945 B1
(45) Date of Patent: Aug. 13, 2002

(54) GARMENT HAVING BREAST ENHANCEMENT FEATURES

(76) Inventors: Barbara S. Stephens; Kimberly A. Lohman, both of 5748 E. Glade Ave., Mesa, AZ (US) 85206

( * ) Notice: Subject to any disclaimer, the term of this patent is extended or adjusted under 35 U.S.C. 154(b) by 0 days.

(21) Appl. No.: 09/771,470

(22) Filed: Jan. 26, 2001

(51) Int. Cl.[7] ..... A41C 3/00
(52) U.S. Cl. ..... 450/37; 450/54; 450/57
(58) Field of Search ..... 450/1, 7, 8, 10, 450/11, 19, 20, 30–32, 38, 39, 54–57, 65, 66; 2/267, 268, 455, 456, 67

(56) References Cited

U.S. PATENT DOCUMENTS

| | | | | | |
|---|---|---|---|---|---|
| 3,122,143 | A | | 2/1964 | McShea | |
| 3,348,241 | A | * | 10/1967 | Dadds | 450/54 |
| 4,289,137 | A | | 9/1981 | Dell et al. | |
| 4,781,650 | A | * | 11/1988 | Budd | 450/55 |
| 4,816,005 | A | | 3/1989 | Braaten | |
| 5,098,330 | A | * | 3/1992 | Greenberg | 450/55 |
| 5,478,278 | A | * | 12/1995 | Greenblatt | 450/32 |
| 5,678,246 | A | * | 10/1997 | Cooley et al. | 2/67 |
| 5,871,388 | A | | 2/1999 | Lambert | |
| 5,873,768 | A | | 2/1999 | Fleischman-Ament et al. | |
| 5,946,726 | A | * | 9/1999 | Green | 2/109 |
| 6,048,252 | A | * | 4/2000 | Sebring | 450/1 |
| 6,095,893 | A | * | 8/2000 | Lin | 450/38 |
| 6,110,005 | A | * | 8/2000 | Stephenson et al. | 450/57 X |
| 6,183,339 | B1 | * | 2/2001 | Thompson | 450/1 |

* cited by examiner

*Primary Examiner*—Gloria M. Hale
(74) *Attorney, Agent, or Firm*—Parsons & Goltry; Robert A. Parsons; Michael W. Goltry

(57) ABSTRACT

A garment including a front portion and an opposing back portion that are coupled together with shoulder and side straps, and substantial cups carried by the front portion for breast enhancement, wherein each of the cups includes an insert having an upper extremity and a lower extremity and that enlarges gradiently from the upper extremity to the lower extremity.

13 Claims, 2 Drawing Sheets

GARMENT HAVING BREAST ENHANCEMENT FEATURES

FIELD OF THE INVENTION

This invention relates to garments having breast enhancement features such as brassieres and active-wear garments for women.

BACKGROUND OF THE INVENTION

The female breast is mostly fatty tissue, lacks overlying muscle and is supported by skin and ligaments, which lose elasticity over time. Given the importance many women and men place on perky or well-presented breasts, the art is replete with various surgical and non-surgical techniques for breast enhancement.

Of particular significance are brassieres and active wear garments for women, which incorporate features that are designed to support and lift the breasts and even make them appear larger than their actual size. Although skilled artisans have devoted considerable effort toward providing garments that function to enhance breasts, existing breast enhancement garments are uncomfortable, can impede circulation and adversely affect the function of the lymphatic system, are difficult to construct and are rather expensive. Given these and other deficiencies in the art, there is a need for an improved garment having breast enhancement features that are comfortable and easy to construct and simple to use, and that make even the most modest breast appear fuller, rounder, larger and more voluptuous.

SUMMARY OF THE INVENTION

The above problems and others are at least partially solved and the above purposes and others realized in a new and improved active-wear garment. In accordance with the invention, the garment is comprised of a front portion and an opposing back portion that are coupled together with shoulder and side straps, and substantial cups carried by the front portion for breast enhancement. Each cup includes an insert having a width, upper and lower extremities and opposing inner and outer side extremities. Each insert enlarges or otherwise thickens gradiently along substantially its entire width from its upper extremity to its lower extremity for lifting each of the breasts. Each insert also enlarges or otherwise thickens gradiently from its inner side extremity to and including its outer side extremity for pushing the breasts together for enhanced cleavage. Each insert is preferably carried by one of a plurality of pockets of the front portion. The pockets are preferably closed, but they may each have an open end or at least an openable end for allowing the inserts placed into and removed from the pockets.

The invention also contemplates associated methods of making a garment and of enhancing breasts.

BRIEF DESCRIPTION OF THE DRAWINGS

Referring to the drawings.

DETAILED DESCRIPTION OF A PREFERRED EMBODIMENT

Figure 1:
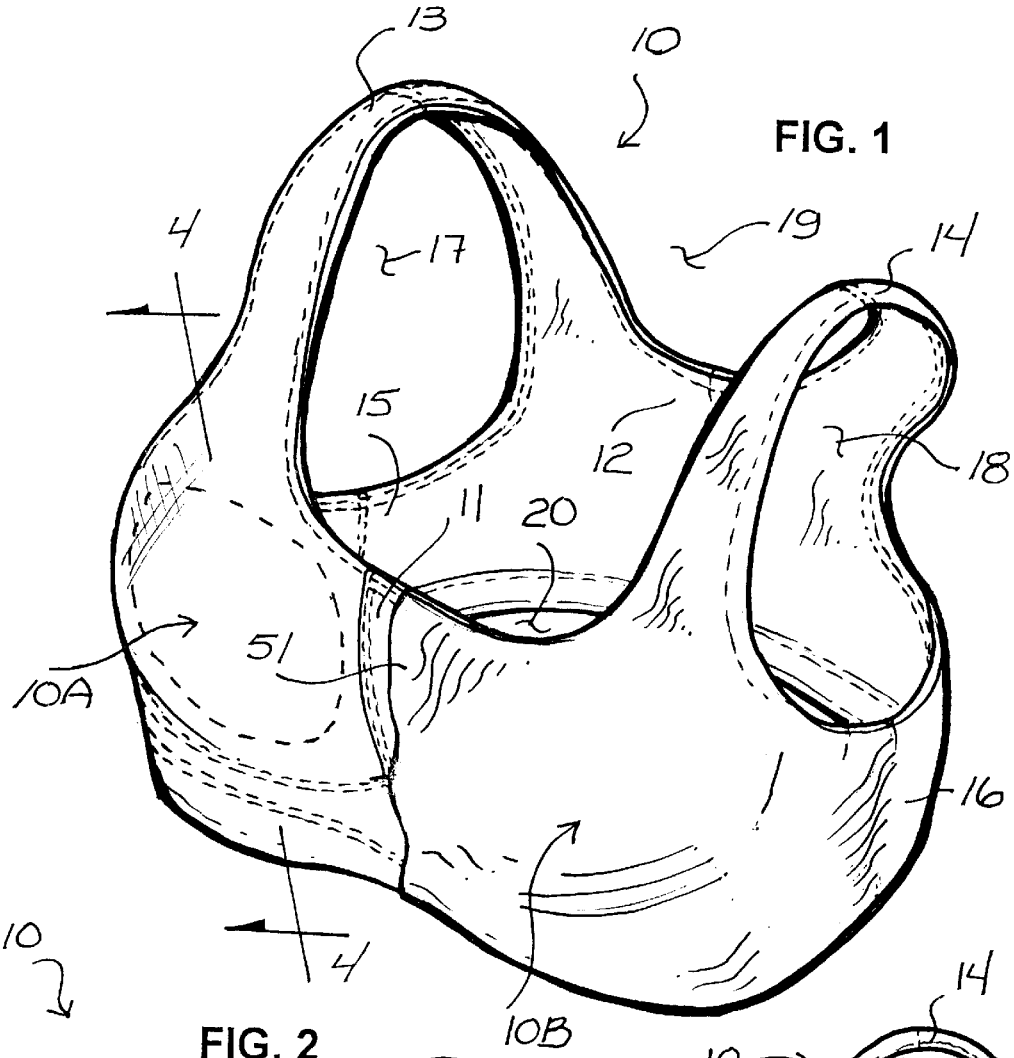
FIG. 1 is a perspective view of a garment having breast enhancement features constructed and arranged in accordance with the invention.

Referring to the drawings, FIG. 1 illustrates a garment 10 having breast enhancement features 10A and 10B that are constructed and arranged in accordance with the invention. Garment 10 is an active-wear or shape-wear garment for supporting and enhancing the breasts during physical activities such as running, cycling, volleyball, aerobics, rowing, kayaking, etc.

Figure 2:
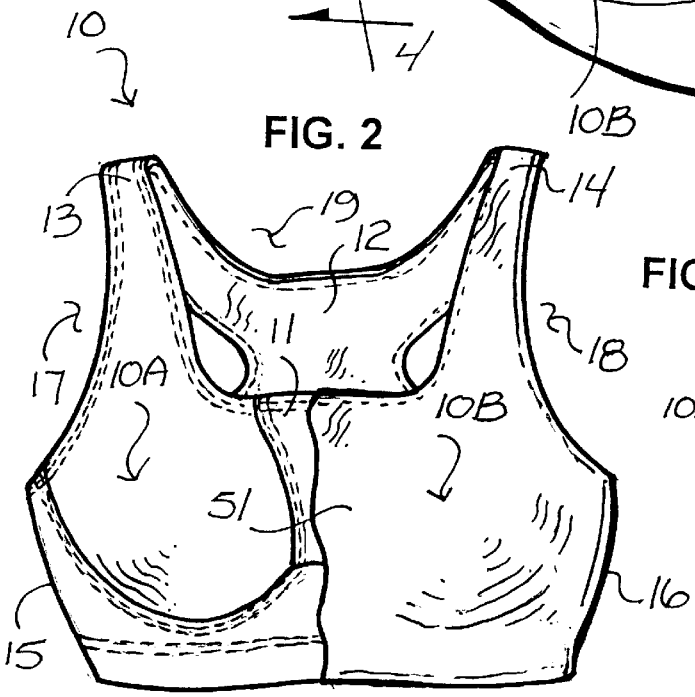
FIG. 2 is a front view of the garment of FIG. 1.
Figure 3:
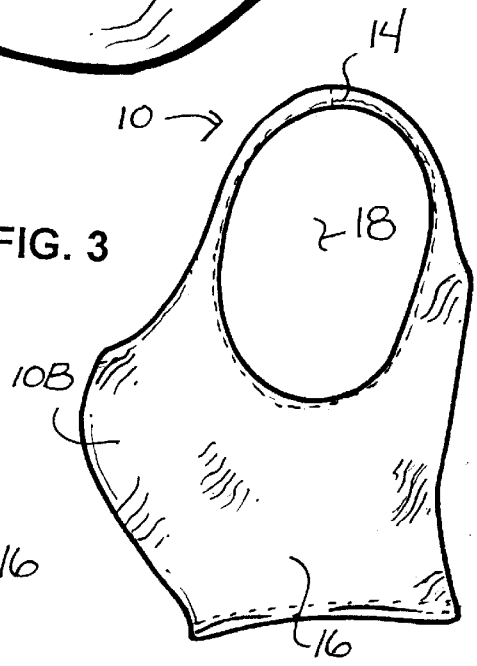
FIG. 3 is a side view of the garment of FIG. 1.

Regarding in relevant part FIGS. 1–3, garment 10 is comprised generally of a front portion 11 that is coupled to an opposing back portion 12 with shoulder straps 13 and 14 and side straps 15 and 16. Garment 10 has free edges that define opposing arm openings 17 and 18 for accommodating a wearer's arms, a neck opening 19 for accommodating the wearer's neck and a central opening 20 for accommodating the wearer's torso generally about the chest and shoulder blades. Garment 10 is designed to fit snugly, firmly and yet comfortably, and breast enhancement features 10A and 10B are substantial cups formed to overlie and snugly encase and support each of the wearer's breasts. With no under-wire or other form of rigid or substantially rigid breast supporting feature, garment 10 provides exemplary breast support but does not adversely impact the lymphatic system or blood circulation to and around the breasts.

Breast enhancement features 10A and 10B are located at and carried or otherwise supported or defined by front portion 11 and are substantially identical. For the sake of brevity, only the structural details of feature 10A will be discussed in connection with FIG. 4. Feature 10A is employed in connection with the right breast and is a substantial cup that is comprised of a receptacle or pocket 30 that contains an insert 31. Pocket 30 is considered part of front portion 11 and is essentially a substantial enclosure that is formed as a substantially continuous sidewall 32. Sidewall 32 includes an upper end 33 directed generally toward neck opening 19 or otherwise away from central opening 20 and a lower end 34 directed toward central opening 20 (openings 19 and 20 are not shown in FIG. 4, but are each clearly shown in FIG. 1). Sidewall 32 bounds a chamber 35 and insert 31 is contained in chamber 35. Sidewall 32 defines the shape of chamber 35, namely, that of a substantial disk, and other elongate and enlarged and generally flattened shapes may be used consistent with the teachings of this invention. Chamber 35 is narrow along upper end 33 and enlarges or otherwise thickens gradiently from upper end 33 to and including lower end 34 as substantially shown.

Figure 5:
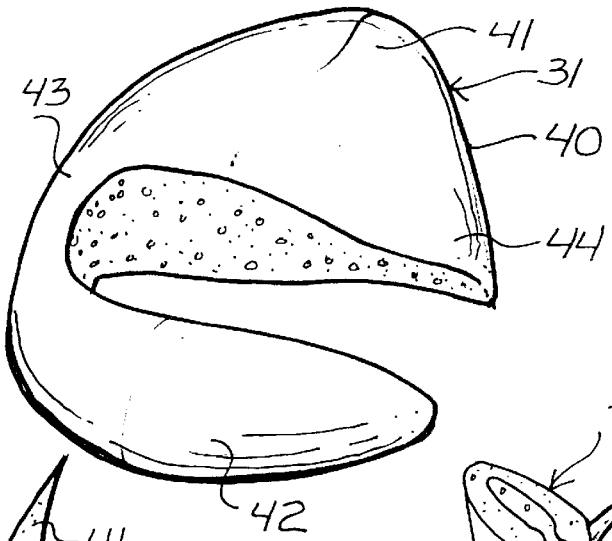
FIG. 5 is a perspective view of the insert of FIG. 4.
Figure 6:
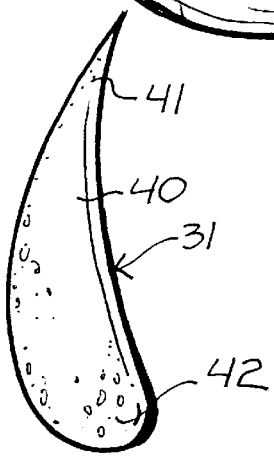
FIG. 6 is a side view of the insert of FIG. 4.
Figure 7:
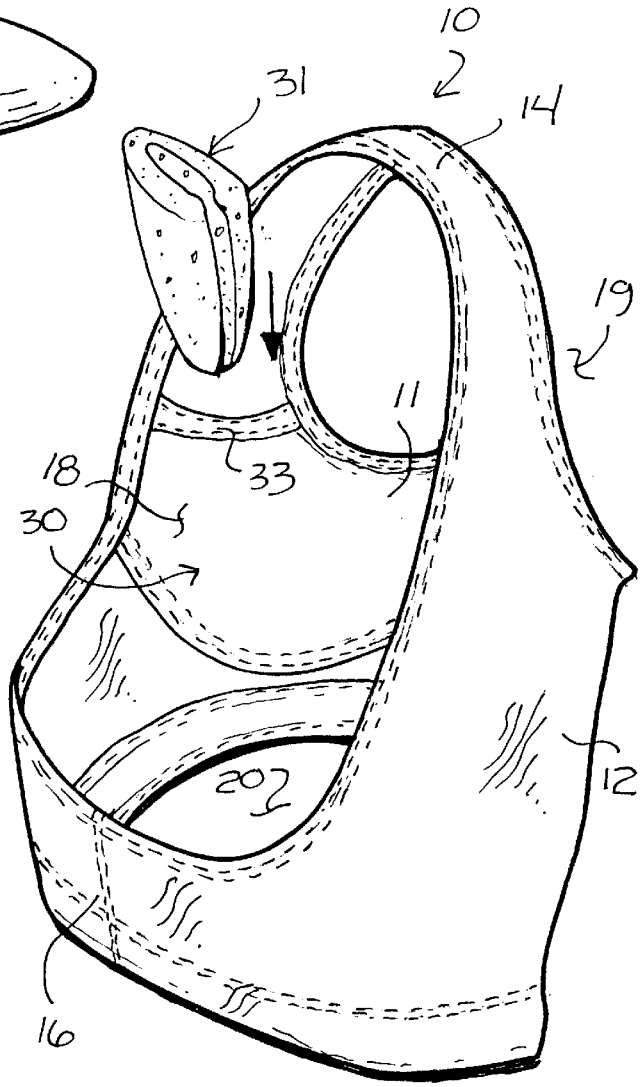
FIG. 7 is a rear perspective view of a portion of the garment of FIG. 1 and the insert of FIG. 4 as it would appear positioned adjacent an open end of a pocket of the garment in a folded condition.
Figure 4:
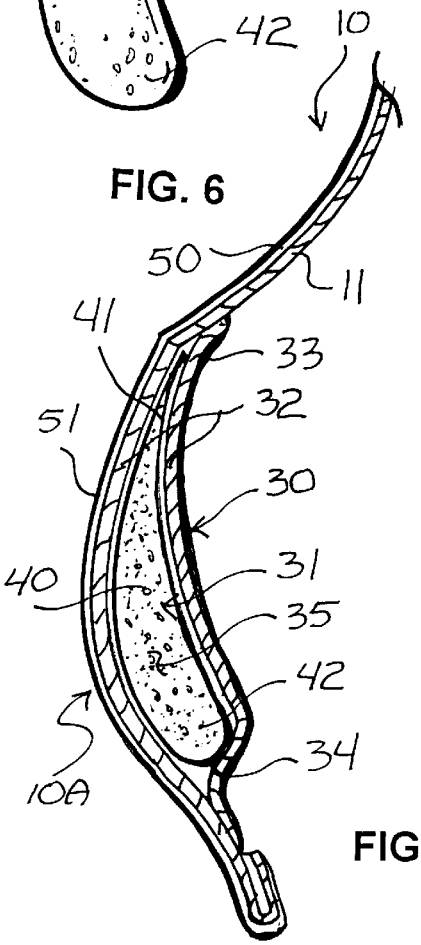
FIG. 4 is a sectional view taken along line 4—4 of FIG. 1 and showing a pocket containing an insert for breast enhancement.

With continuing attention to FIG. 4 and additional reference to FIGS. 5 and 6, insert 31 is substantially the same shape as chamber 35, namely, a body 40 shaped as a substantial disk, and other elongate and enlarged and generally flattened shapes may be used consistent with the teachings of this invention. Body 40 includes a width, upper and lower ends or extremities 41 and 42, and opposing side or lateral extremities 43 and 44. Body 40 is narrow along upper end 41 and enlarges or otherwise thickens gradiently from upper end 41 to and including lower end 42 as substantially shown. Body 40 is also narrow or thin along extremity 44 and enlarges or otherwise thickens gradiently from extremity 44 to and including extremity 43 and this can be reversed. It is preferred that body 40 thicken gradiently along substantially its entire width from upper end 41 to and including lower end 42 for supporting the breast from beneath the breast, which serves to lift the breast to provide breast enhancement and breast cleavage in accordance with the invention. Because body 40 in this example is employed with the right breast, extremity 43 is intended to reside along the outer side of the right breast for supporting the right breast from its outer side, which serves to push the right breast inwardly toward the left breast for further enhancing cleavage. As generally shown in FIG. 4, insert 31 is substantially coextensive with chamber 35 and is, therefore, held securely therein, with upper end 41 directed toward upper end 33 of pocket 30 and lower end 42 directed toward lower end 34 of pocket 30. In terms of construction, body 40 is formed from a resilient material or foam or elastomeric composition that, although deformable, is configured to resume and maintain its substantial shape. Body 40 may be enclosed in a protective sheath if desired. Pocket 30 faces the wearer of garment 10. Upper end 33 of pocket 30 is preferably closed such as with stitching to prevent deformation or loss of insert 31. However, upper end 33 can be open or at least openable so that insert 31 can be removed for cleaning or replacement as substantially shown in FIG. 7. In FIG. 7, insert 31 is shown as it would appear folded for allowing it to be easily inserted into pocket 30 through open upper end 33. To provide closure, upper end 33 may be provided with fastening structure such as complemental hook and loop elements, complemental snap or button elements, etc.

When garment 10 is properly worn, breast enhancement feature 10A overlies and snugly encases and supports a breast of the wearer, namely, the right breast in this specific example. Feature 10A predominantly resides at and presents against the underside of the breast and the outer or lateral side of the breast. Because the fit of garment 10 is snug and because feature 10A therefore snugly encases and supports the breast from the bottom and the side, the configuration of insert 31 provides a lifting support against the underside of the breast and against the outer side of the breast, lifting it upwardly to make the upper side of the breast appear desirably full and voluptuous and for providing cleavage, and for pushing the breast inwardly toward the left breast for further enhancing cleavage and fullness. The ability of feature 10A to lift the breast rests not only with the snug fit of garment 10 but, more importantly and essentially, with the configuration of insert 31, namely, the gradient enlarging of insert 31 from upper extremity 41 to lower extremity 42. Also, because the majority of insert 31 is positioned at and against the underside of the breast, the bulk provided by lower extremity 42 makes the underside of the breast appear fuller. In this regard, insert 31 serves a number of important purposes, namely, lifting the breast to make the upper side of the breast appear fuller, providing gradiently enlarging bulk at and along the underside of the breast for making the underside of the breast appear fuller and for introducing enhanced cleavage, and providing gradiently enlarging bulk at and along the outer side of the breast for making the outer side of the breast appear fuller and for pushing the breast inwardly toward the other breast for further enhancing cleavage. Breast enhancement feature 10B functions just like breast enhancement feature 10A in connection with the left breast, and will not be discussed as it would be unnecessarily repetitive. In this regard, breast enhancement features 10A and 10B cooperate together to lift the breasts to make them appear fuller and more voluptuous and for providing enhanced cleavage, and for pushing the breasts together for further enhancing cleavage.

Because garment 10 is designed to be snug for allowing breast enhancement features 10A and 10B to provide exemplary breast support during exercise, garment 10 is preferably constructed of a stretchable, moisture-wickable and resilient textile or combination of textiles such as spandex or nylon-spandex or the like, and various textiles and combination of textiles of this general character will readily occur to the skilled artisan. Gluing, heat joining, sewing or any other suitable method for adjoining fabrics joins the various components of garment 10, with sewing being preferred. To conceal any visible seams on the outer surface of garment 10, which is denoted generally in FIG. 4 by the reference numeral 50 and defined collectively by front portion 11, back portion 12, shoulder straps 13 and 14, and side straps or sections 15 and 16, garment 10 further includes an attached and substantially seamless covering 51 overlying outer surface 50. Covering 51 is preferably constructed of a stretchable, moisture-wickable and resilient textile or combination of textiles such as spandex or nylon-spandex or the like, and is attached to garment 10 at or adjacent the edges that bound openings 17–20 by gluing, heat joining, sewing or any other method for adjoining fabrics, with sewing being preferred. Covering 51 hides the seams to permit use of garment 10 as an outer wear garment, and additionally in concert with the rest of garment 10 acts to conceal the nipple for modesty.

The invention has been described above with reference to one or more preferred embodiments. However, those skilled in the art will recognize that changes and modifications may be made in the described embodiments without departing from the nature and scope of the invention. For instance, the breast enhancement features of garment 10 can be formed as a single pocket that contains a single insert of a construction described herein. In this alternate embodiment of the invention, the garment includes a front portion having substantial cups for breast enhancement as substantially set forth. The cups include an insert that defines upper and lower major extremities at each of the cups and opposing side extremities at each of the cups, wherein the insert enlarges or otherwise thickens gradiently at each of the cups from each of the upper extremities to and including each of the lower extremities and from each one of the lateral and/or side extremities to and including each of the other of the medial and/or lateral side extremities in accordance with the teachings of the invention. The insert defining the cups is carried by a pocket of the front portion of the garment, and the pocket preferably includes at least one open end for allowing the insert to be inserted into and removed from the pocket.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A garment including a front portion having substantial cups for breast enhancement, each of the cups including an insert carried by the front portion and having upper and lower extremities, wherein the insert enlarges gradiently from the upper extremity to the lower extremity.

2. The garment of claim 1, wherein each insert is carried by one of a plurality of pockets of the front portion.

3. The garment of claim 1, further including a back portion opposing the front portion and shoulder and side straps coupling the front portion to the back portion.

4. The garment of claim 3, further including an outer surface defined by the front portion, the back portion and the shoulder and side straps, and an attached and seamless covering overlying the outer surface.

5. The garment of claim 1, wherein the insert further includes opposing side extremities and enlarges gradiently from one of the side extremities to and including the other of the side extremities.

6. A garment including a front portion having substantial cups for breast enhancement, the cups including an insert that defines upper and lower major extremities at each of the cups, wherein the insert enlarges gradiently at each of the cups from each of the upper extremities to and including each of the lower extremities.

7. The garment of claim 6, wherein each insert is carried by a pocket of the front portion.

8. The garment of claim 6, further including a back portion opposing the front portion and shoulder and side straps coupling the front portion to the back portion.

9. The garment of claim 8, further including an outer surface defined by the front portion, the back portion and the shoulder and side straps, and an attached and seamless covering overlying the outer surface.

10. The garment of claim 7, wherein the pocket includes an open end.

11. A garment comprising:

substantial cups for breast enhancement, each of the cups comprising a pocket that contains an insert having upper and lower extremities, wherein the insert enlarges gradiently from the upper extremity to the lower extremity;

a front portion that supports the cups and an opposing back portion coupled to the front portion with shoulder and side straps;

an outer surface defined by the front portion, the back portion and the shoulder and side straps; and an attached and seamless covering overlying the outer surface.

12. The garment of claim 9, wherein the insert of each of the substantial cups is removable from the pocket through an open end thereof.

13. The garment of claim 11, wherein each of the inserts further includes opposing side extremities and enlarges gradiently from one of the side extremities to and including the other of the side extremities.

* * * * *